US005085552A

United States Patent [19]

Lennon

[11] Patent Number: 5,085,552

[45] Date of Patent: Feb. 4, 1992

[54] SURGE FEEDER FOR FEEDING REFUSE MATERIAL INTO A FURNACE

[75] Inventor: Robert R. Lennon, Carmel, Ind.

[73] Assignee: Miller Hofft, Inc., Indianapolis, Ind.

[21] Appl. No.: 484,851

[22] Filed: Feb. 26, 1990

[51] Int. Cl.[5] ..... B02C 4/02; B02C 23/02; F23G 5/44

[52] U.S. Cl. ..... 414/196; 414/172; 414/160; 110/255

[58] Field of Search ..... 414/147, 150, 158, 160, 414/162, 172, 173, 187, 193, 195, 196, 211, 268; 198/533, 612, 613; 239/682, 683; 222/271, 272, 281; 110/255, 235, 236, 222; 241/236, DIG. 38

[56] References Cited

U.S. PATENT DOCUMENTS

| | | | |
|---|---|---|---|
| 2,846,125 | 8/1958 | Gandrud | 222/272 |
| 3,065,842 | 11/1962 | Nowak | 239/682 |
| 3,635,176 | 1/1972 | Gottlieb | 110/222 |
| 3,773,001 | 11/1973 | Bottalico | 110/222 X |
| 4,321,877 | 3/1982 | Schmidt et al. | 110/255 X |
| 4,380,285 | 4/1983 | Bürkner et al. | 198/533 |

FOREIGN PATENT DOCUMENTS

| | | | |
|---|---|---|---|
| 11535 | 7/1899 | Fed. Rep. of Germany | 222/272 |
| 3306512 | 8/1984 | Fed. Rep. of Germany | 110/255 |
| 0078730 | 6/1981 | Japan | 414/160 |

*Primary Examiner*—Frank E. Werner
*Assistant Examiner*—Brian K. Dinicola
*Attorney, Agent, or Firm*—Woodard, Emhardt, Naughton, Moriarty & McNett

[57] ABSTRACT

A surge feeder for feeding refuse material into a furnace comprises a plurality of rollers mounted on a base supporting the rollers above the feed opening to the furnace. A chain and sprocket drive mechanism is mounted to the base and serves to counter-rotatably drive the rollers. Each roller has fixedly mounted thereto at equally angularly spaced apart locations a plurality of generally planar shaped paddles which extend continuously along the length of the roller. The paddles project radially from and alternate in height angularly about each roller.

6 Claims, 2 Drawing Sheets

SURGE FEEDER FOR FEEDING REFUSE MATERIAL INTO A FURNACE

BACKGROUND OF THE INVENTION

The present invention relates generally to the field of feeder devices for charging furnaces and, more particularly, to a roller type feeder for surge feeding nonuniform materials, such as refuse, into a refuse incinerator.

In order to optimize the efficiency and safety of the refuse incineration process, it is desirable to control various parameters influencing the manner in which refuse material is fed into the furnace. For example, control of the rate at which refuse is introduced into the furnace serves to optimize the rate of the incineration process. As a further example, it is desirable to minimize the flow of air through the feed opening to the furnace during feeding in order to (1) limit the admission of relatively cold unheated air into the furnace which would otherwise undesirably lessen the furnace temperature, and (2) prevent the release of hot air from inside the furnace through the feed opening which would otherwise not only lessen the furnace temperature but also create a risk of fire developing outside the walls of the furnace. A factor which further complicates the design of feeders for refuse furnaces is that refuse materials are generally nonuniform in size and shape and therefore difficult to feed without undesirably sacrificing the design constraints herein mentioned.

U.S. Pat. No. 974,680 to Leask discloses a refuse feeder device which uses a series of counter-rotating rollers to feed refuse material therebetween into the furnace. Within each of the counter-rotating rollers are eccentrically mounted a number of fingers or prongs, arranged either spirally or in rings, to project through holes in the surface of the rollers. As the rollers rotate, the fingers alternately project and recede below the surface of the rollers to feed forward any material in contact with the rollers and then be cleared from the fingers. Unfortunately, the Leask device is relatively complicated, requiring the use of eccentric rollers, spring bearings, etc. to prevent refuse from sticking to the fingers or jamming between the rollers. Further, the Leask feeder device is inefficient as a barrier preventing flow of air therethrough into and out of the furnace because of the presence of the substantial open space in the interstices between adjacent fingers.

SUMMARY OF THE INVENTION

A surge feeder for feeding refuse material into a furnace, according to one embodiment of the present invention comprises a plurality of rollers, a base rotatably supporting the rollers above the feed opening to the furnace, and a means for counter-rotatably driving the rollers. Each of the rollers is characterized by having a plurality of paddles extending continuously along substantially the entire length of the roller. Further, each of the paddles project radially from their corresponding rollers and are fixedly mounted thereto at locations angularly spaced apart on the rollers. The paddles are further characterized by having a plurality of different heights.

In an alternate embodiment, the surge feeder includes two sets of rollers vertically spaced apart above the feed opening to the furnace. The sets of rollers are movably mounted up and down relative to one another to vary the distance therebetween.

Accordingly, it is an object of the present invention to provide an improved feeder for feeding refuse material into a furnace.

It is a further object of the present invention to provide a surge feeder which improves the efficiency and safety of the incineration process by substantially restricting the feed opening to the furnace when refuse is being fed therein.

A yet further object of the present invention is to provide a surge feeder having the advantages previously set forth and which is relatively simple in overall design.

Related objects and advantages of the present invention will become more apparent by reference to the following figures and detailed description.

BRIEF DESCRIPTION OF THE DRAWINGS

FIG. 4 is a schematic elevation view of an alternative preferred embodiment of the surge feeder of the present invention.

DESCRIPTION OF THE PREFERRED EMBODIMENT

Figure 1:
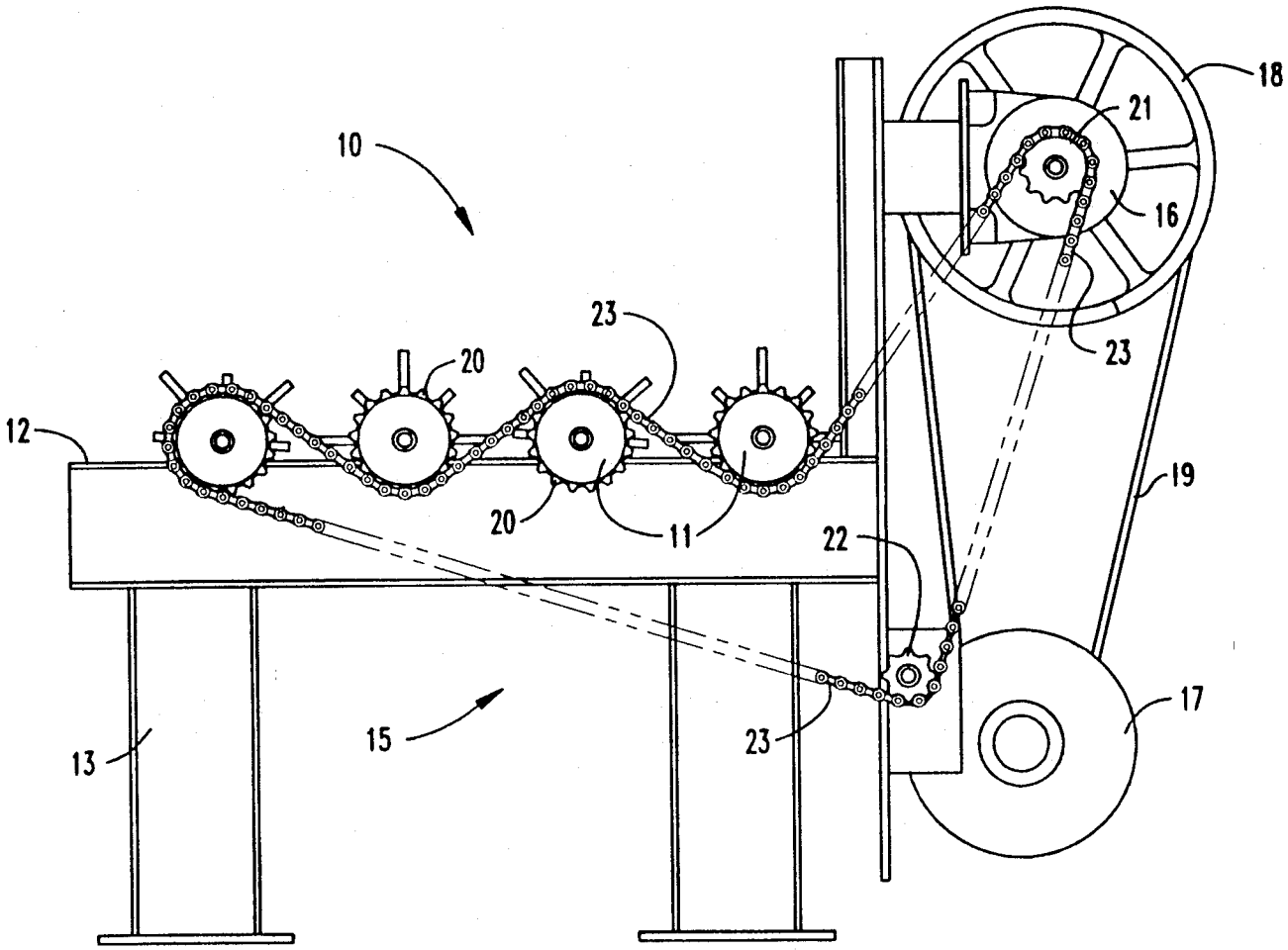
FIG. 1 is a schematic elevation view of the surge feeder of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, a first embodiment of the surge feeder of the present invention is generally identified at 10 in FIG. 1. The feeder 10 includes a series of four rollers 11 rotatably mounted in horizontal alignment on the base 12 of frame 13. Although not shown, the frame 14 is fixedly mounted in use over the feed opening of a furnace such as is conventionally used for incinerating refuse materials.

A chain and sprocket drive train mechanism 15 serves as a common drive train for driving the rollers 11 in a counter-rotating fashion as indicated by the arrows in FIG. 1. Drive train mechanism 15 is operably coupled to the output shaft of a gearbox 16 driven by an electric motor 17 via pulley 18 and belt 19. Drive train mechanism 15 includes sprockets 20 mounted to each of the rollers 11, a drive sprocket 21 connected to the output shaft of gearbox 16, and idler sprocket 22 drivably connected to sprockets 20 by drive chain 23.

Figure 2:
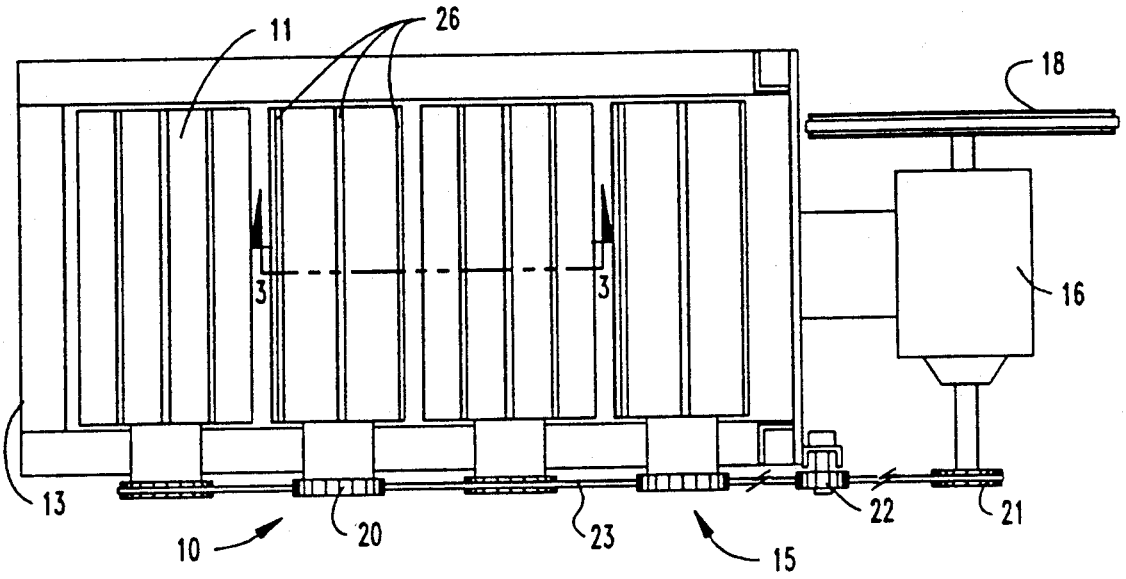
FIG. 2 is a top view of the surge feeder of FIG. 1.
Figure 3:
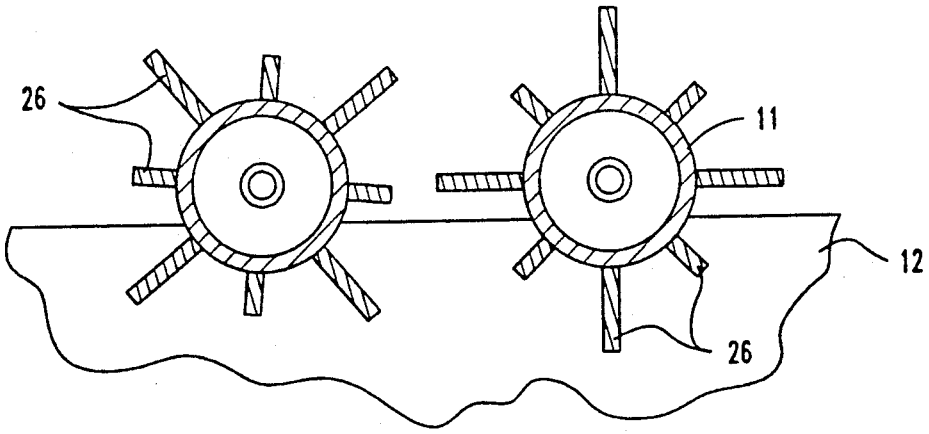
FIG. 3 is a section view, enlarged relative to FIG. 1, taken through lines 3—3 in FIG. 2.

Referring particularly to FIG. 2, the construction of the rollers 11 will now be described in greater detail. The rollers 11 are of identical construction and therefore a description of one is sufficient to describe each of the rollers. Rollers 11 are generally cylindrically shaped. Projecting radially from each roller 11 at angularly spaced apart locations thereon are a plurality of paddles 26. In the preferred embodiment depicted in FIGS. 1 and 2 there are eight paddles 26 equally angularly spaced apart around the roller 11. It should be understood, however, that the number of paddles 26 may be varied, if desired, without departing from the scope of the present invention.

Each of the paddles 26 is generally orthogonally shaped in the form of a slat and extends lengthwise continuously along substantially the entire length of the roller 11 parallel to the axis of rotation thereof. Paddles 26 are rigidly attached to the roller 11, either being integrally formed therewith or otherwise suitably affixed thereto. The paddles 26 have a plurality of different heights h which serve to provide a surge feeding movement to the rollers 11. In the preferred embodiment depicted in FIGS. 1 and 2 the paddles 26 have two different heights $h_1$ and $h_2$ arranged in an alternating fashion around the roller 11. The relationship between paddles 26 on adjacent rollers 11 may be staggered so that the paddles do not interfere with one another as they counter-rotate. This also permits the height of the paddles 26 to be increased so as to effectively further restrict the passage of air through the openings between the rollers 11.

It is to be noted that because the paddles 26 extend continuously along the length of the rollers 11, passage of air through the opening between the rollers 11 is effectively restricted while still allowing refuse to be fed therethrough at satisfactory rates. In the preferred embodiment, four rollers 11 are provided, however, the number of rollers may be increased or decreased depending upon the maximum size of objects which are intended to be fed through the rollers 11.

An alternate preferred embodiment of the present invention is depicted in FIG. 4. Where appropriate, identical reference numerals have been used to identify elements which correspond to those in the previous preferred embodiment. This embodiment is constructed similarly to the previous embodiment except that a second series of rollers 11' is mounted to the frame spaced vertically above the first series of rollers 11. The second series of rollers 11' may be driven either by a drive train mechanism operably connected in common to the output shaft of gearbox 16 or by a second drive motor via an independent drive train mechanism mounted to frame 13. The second series of rollers 11' are mounted so as to move in unison vertically on frame 13 and thereby permit the distance between the rollers 11 and 11' to be varied as desired. The second series of rollers 11' serves to provide a further barrier to the flow of air through the feed opening without substantially impeding the rate in which refuse can be fed into the furnace.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A surge feeder for feeding refuse material into a furnace having a feed opening, comprising:

a first plurality of rollers;

a second plurality of rollers spaced vertically above said first plurality of rollers;

a base rotatably supporting said first and second plurality of rollers above the feed opening to the furnace; and a means for counter-rotatably driving said first and second plurality of rollers;

wherein each said roller has a plurality of paddles extending continuously along substantially the entire length of said roller, said paddles projecting radially from said roller and fixedly mounted thereto at locations angularly spaced apart on said roller, said paddles having a plurality of different heights.

2. The surge feeder of claim 1 wherein said second plurality of rollers is movably mounted o said base for vertical movement thereon, whereby the distance between said first and second plurality of rollers may be varied.

3. The surge feeder of claim 1 wherein said paddles alternate in height angularly about each said roller.

4. The surge feeder of claim 3 wherein said paddles are equally angularly spaced apart about each said roller.

5. The surge feeder of claim 1 wherein said drive means is a chain and sprocket drive mechanism.

6. The surge feeder of claim 1 wherein each said paddle has a generally orthogonal shape and extends longitudinally in a direction parallel to the axis of rotation of said roller and said paddles on adjacent rollers are arranged in a staggered angular relationship and sized to minimize air flow through the feed opening to the furnace.

* * * * *

UNITED STATES PATENT AND TRADEMARK OFFICE

CERTIFICATE OF CORRECTION

PATENT NO. : 5,085,552

DATED : February 4, 1992

INVENTOR(S) : Robert R. Lennon

It is certified that error appears in the above-identified patent and that said Letters Patent is hereby corrected as shown below:

In Column 4 at Line 30, "o" should read --to--.

Signed and Sealed this

First Day of June, 1993

*Attest:*

Michael K. Kirk

MICHAEL K. KIRK

*Attesting Officer*

*Acting Commissioner of Patents and Trademarks*